US007032499B2

(12) United States Patent
Domann

(10) Patent No.: US 7,032,499 B2
(45) Date of Patent: Apr. 25, 2006

(54) HYDRAULIC CIRCUIT AND METHOD FOR OPERATING A SEALING DEVICE

(75) Inventor: Robert E. Domann, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 22 days.

(21) Appl. No.: 10/897,059

(22) Filed: Jul. 22, 2004

(65) Prior Publication Data

US 2006/0016326 A1 Jan. 26, 2006

(51) Int. Cl.
*F15B 13/04* (2006.01)

(52) U.S. Cl. ..... 91/443; 166/77.3

(58) Field of Classification Search ..... 91/28, 91/443, 446, 448; 60/462; 166/77.1, 77.2, 166/77.3

See application file for complete search history.

(56) References Cited

U.S. PATENT DOCUMENTS 4,585,061 A * 4/1986 Lyons et al. ..... 166/77.3
4,655,291 A * 4/1987 Cox ..... 166/385
6,173,769 B1 1/2001 Goode ..... 166/77.3
6,216,780 B1 4/2001 Goode et al. ..... 166/77.3
6,260,467 B1 * 7/2001 Mickelson et al. ..... 91/31
6,264,128 B1 * 7/2001 Shampine et al. ..... 242/397.3
6,367,557 B1 4/2002 Rosine et al. ..... 166/384
2003/0209346 A1 11/2003 Austbo et al. ..... 166/77.2

OTHER PUBLICATIONS

Patent Application entitled "Apparatus and Method For Injecting Tubing In A Well Bore" by Robert E. Domann et al., filed on May 6, 2004, U.S. Appl. No. 10/840,786.

Patent Application entitled "Hydraulic Circuit and Method for Operating A Gripping Device" by Robert E. Domann, filed on May 6, 2004, U.S. Appl. No. 10/840,787.

* cited by examiner

*Primary Examiner*—Thomas E. Lazo
(74) *Attorney, Agent, or Firm*—John W. Wustenberg; Haynes & Boone, LLP

(57) ABSTRACT

A hydraulic circuit and method for operating a hydraulic device according to which fluid is passed from a source to the device while some of the fluid is passed to a valve that is adjustable to control the amount of fluid passed to it and therefore the amount of fluid passed to the device.

33 Claims, 2 Drawing Sheets

HYDRAULIC CIRCUIT AND METHOD FOR OPERATING A SEALING DEVICE

BACKGROUND

The present invention relates generally to operating a hydraulic device and in particular to a hydraulic circuit connected to a stripper for sealing off and holding wellbore fluids in a well, and a method of controlling the sealing of tubing associated therewith.

Coiled tubing injectors are used to grip and advance coiled tubing into a well via a wellhead. Many coiled tubing injectors utilize a stripper to seal off and hold wellbore fluids in the well. The stripper, also called a stripper/packer, lubricator, or stuffing box, is typically positioned above the wellhead and utilizes one or more hydraulic actuated cylinders to press stripper elements (or pack-off elements) against the coiled tubing while the tubing is being inserted into or removed from the well, thereby sealing the wellhead and preventing the release of wellbore fluids from the well. The cylinder or cylinders in the stripper are controlled using a stripper hydraulic circuit connected thereto.

Several potential problems arise during the operation of a typical stripper hydraulic circuit. For example, if the diameter of the tubing increases during the operation of a typical stripper hydraulic circuit, there may be an unsafe pressure increase in the circuit. Also, many stripper hydraulic circuits require a human operator to move near the stripper during operation to adjust the sealing pressure on the tubing, thus increasing the risk of harm to the operator. Further, if there is a loss of pressure to the stripper hydraulic circuit, the seal against the tubing will be broken and wellbore fluids will be released from the wellhead, creating both a safety and environmental hazard and possibly damaging any equipment in the vicinity of the wellhead.

Current solutions to a loss of pressure in the stripper hydraulic circuit include using a shut-off valve to isolate the stripper hydraulic circuit after the loss of pressure, or connecting a check valve upstream of the stripper hydraulic circuit to hold pressure in the stripper hydraulic circuit. Although these solutions prevent a complete loss of pressure to the stripper hydraulic circuit, they do not provide an easy way for the human operator to resume control of the stripper hydraulic circuit after the pressure has been restored. In addition, neither of these solutions enables the sealing pressure on the tubing to be increased in the event of a loss in pressure to the hydraulic circuit or other unforeseen emergency.

Therefore, what is needed is a hydraulic circuit for controlling a stripper that overcomes these problems.

DETAILED DESCRIPTION

Figure 1:
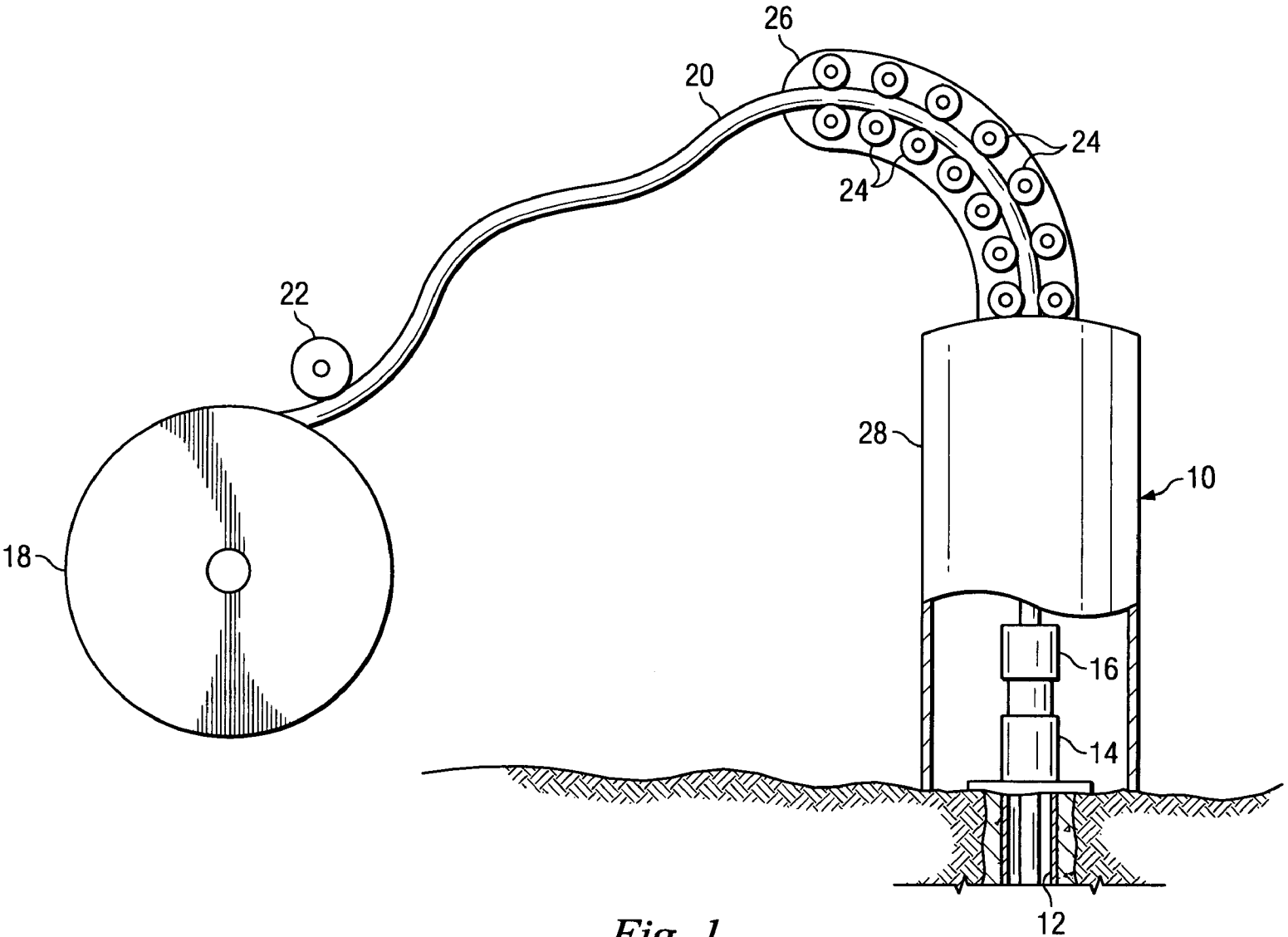
FIG. 1 is a partial elevational/partial sectional view, not necessarily to scale, depicting a stripper that employs a hydraulic circuit according to an embodiment of the invention.

Referring to FIG. 1, the reference numeral 10 refers to a coiled tubing injector positioned above a well 12. A wellhead 14 extends above the well 12, and a stripper 16 extends above the wellhead 14.

A spool of coiled tubing 18 is positioned at a predetermined location away from the injector 10. Unspooled tubing 20 passes from the spool 18 and under a measuring device, such as a wheel 22, and between several (seven in the example of FIG. 1) pairs of opposed rollers 24 rotatably mounted to an arcuate support platform 26. The tubing 20 then passes from the last pair of rollers 24 into the injector 10. The injector 10 includes a frame 28 inside of which a pair of carriages are mounted (not shown). The carriages of the injector 10 drive the tubing 20 into the stripper 16 for passage through the wellhead 14 and into the well 12.

Figure 2:
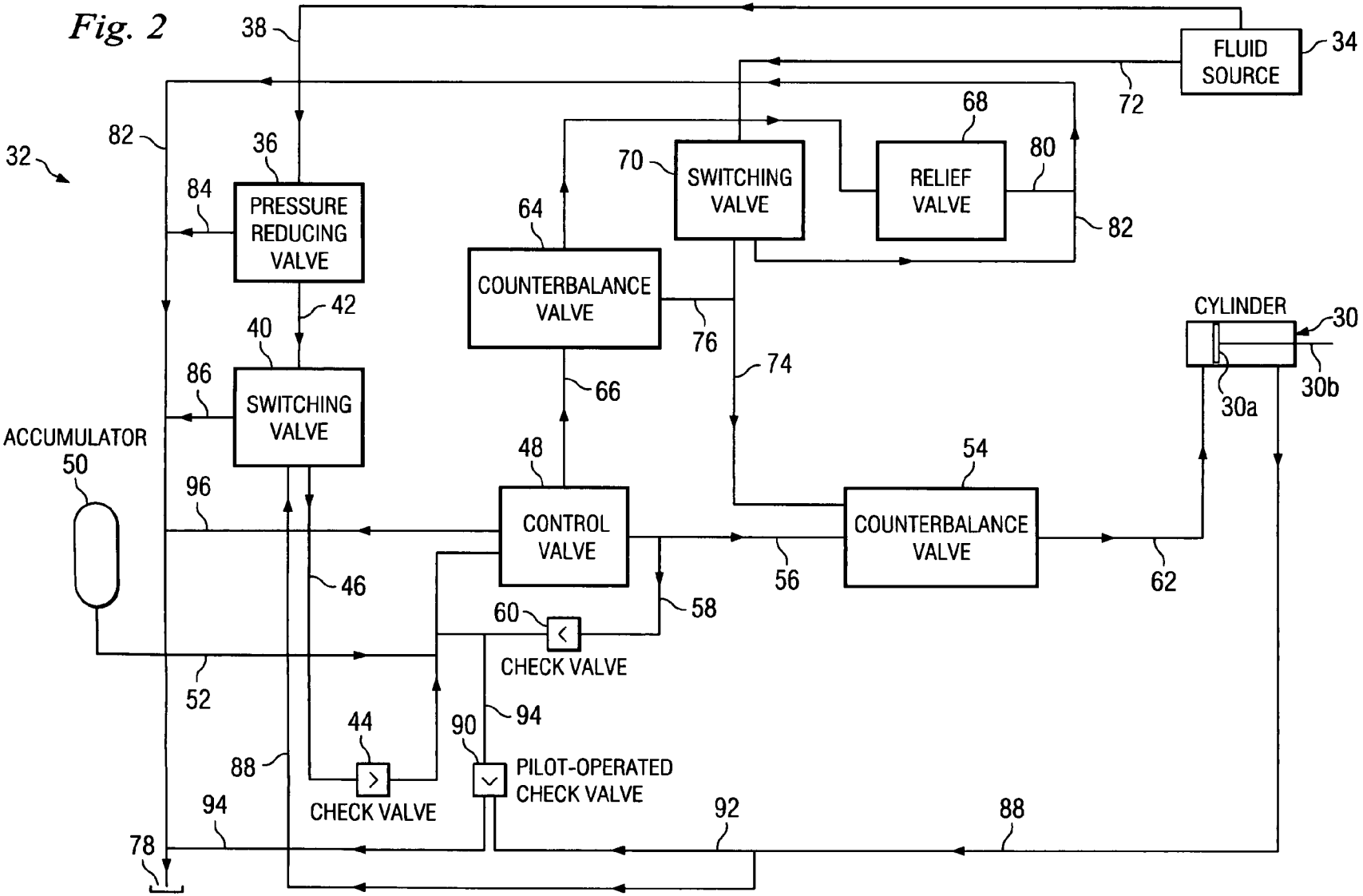
FIG. 2 is a diagrammatic view depicting the hydraulic circuit employed by the stripper, according to an embodiment of the invention.

Referring to FIG. 2, a hydraulic actuated cylinder 30 is connected to the stripper 16 (not shown) in a conventional manner and includes a piston 30*a* that reciprocates in a cylinder housing in response to hydraulic fluid being introduced into, and discharged from, the cylinder housing, in a conventional manner. One end of a rod 30*b* is connected to the piston 30*a* and a portion of the rod 30*b* extends out from the cylinder 30, and is engaged with the stripper 16 in a conventional manner.

The cylinder 30 is connected in a hydraulic circuit, generally referred to by the reference numeral 32, so that fluid is selectively introduced and discharged from the cylinder 30 to cause corresponding extension and retraction of the cylinder 30, as will be further described. This extension and retraction of the cylinder 30 causes the stripper 16 to sealingly engage the tubing 20, and to release the tubing 20, respectively, in any conventional manner. For example, two arcuate or semi-circular elements may extend around the tubing 20, and the rod 30*b* may be connected to one element so that extension of the cylinder 30 causes the one element to move towards the other and press against the tubing 20, thereby sealingly engaging the tubing 20.

The circuit 32 includes a source 34 of pressurized hydraulic fluid which is connected to a pressure reducing valve 36 in the circuit via a line 38. An output from the pressure reducing valve 36 is connected to a switching valve 40 via a line 42. An output from the switching valve 40 is connected to a check valve 44 via a line 46 that also extends from the check valve 44 to the input of a control valve 48. The check valve 44 permits fluid flow in a direction indicated by the flow arrows, but prevents flow in the opposite direction. An accumulator 50 is connected to the line 46 between the check valve 44 and the control valve 48 via a line 52. The accumulator 50 is adapted to store fluid from the circuit 32 and introduce the stored fluid into the circuit 32 under conditions to be described.

An output from the control valve 48 is connected to a counterbalance valve 54 via a line 56. The counterbalance valve 54 is normally closed but can be opened under conditions to be described. A line 58 extends from the line 56 at a location downstream of the control valve 48 to a check valve 60 and, from the check valve 60, to the line 46 at a location upstream of the control valve 48. The check valve 60 permits fluid flow in a direction indicated by the flow arrows, but prevents flow in the opposite direction. It is understood that the control valve 48 includes a relief mechanism (not shown) and its function will be described in detail.

The counterbalance valve 54 is also connected to a line 62 which, in turn, is connected to one end portion of the cylinder 30. Thus, fluid flows from the source 34, through the valves 36, 40, 44, 48 and 54 and to the cylinder 30 for actuating the cylinder 30 in a manner to be described. It is understood that the counterbalance valve 54 includes a check valve that will permit fluid flow in this manner but will prevent fluid flow in the opposite direction.

Another output from the control valve 48 is connected to a counterbalance valve 64 via a line 66 that extends to a relief valve 68. The counterbalance valve 64 is normally closed but is opened under conditions to be described, and the relief valve 68 is adjustable to control pressure reduction across the control valve 48, from the line 46 to the line 56. The control valve 48 is configured to allow some fluid to pass through it from the line 46 to the line 56, while allowing some fluid to be diverted, or bled off, from the control valve 48 to the line 66 and the counterbalance valve 64, for passage to the relief valve 68, all under conditions to be described.

The source 34 is also connected to a switching valve 70 via a line 72. The switching valve 70 is connected to the counterbalance valve 54 via a line 74, and is connected to the counterbalance valve 64 via the line 74 and a line 76. The lines 74 and 76 act as pilot lines for the counterbalance valves 54 and 64, respectively, and, as such, control the operation of the valves.

The relief valve 68 and the switching valve 70 are connected to an exhaust tank 78 via lines 80 and 82, and the line 82, respectively. The switching valve 70 normally connects the line 74 to the source 34 via the line 72, but is adapted to be switched to terminate this connection and connect the line 74 to the tank 78 via the line 82, under conditions to be described.

The pressure reducing valve 36 is connected to the tank 78 via a line 84 and the line 82, and is configured to allow some fluid to pass through it from the line 38 to the line 42, while allowing some fluid to be diverted from the pressure reducing valve 36 to the tank 78, all under conditions to be described.

The switching valve 40 is connected to the tank 78 via a line 86 and the line 82, and is also connected to the other end portion of the cylinder 30 via a line 88 to enable fluid to flow from the cylinder 30 to the tank 78 via the switching valve 40 and the lines 88, 86 and 82, as indicated by the flow arrows. The switching valve 40 normally connects the line 42 to the line 46, and the line 88 to the line 86. However, the switching valve 40 is adapted to be switched so that it connects the line 42 to the line 88, and connects the line 46 to the line 86, under conditions to be described.

The line 88 is also connected to a pilot-operated check valve 90, via a pilot line 92, and the check valve 90 is, in turn, connected to the line 58 via a line 94 that extends from the line 58 to the line 82. The check valve 90 normally prevents flow through the line 94 and is adapted to open when fluid is received from the pilot line 92 to permit flow through the line 94 and to the tank 78 via the line 82, as indicated by the flow arrows and under conditions to be described.

The control valve 48 is connected to the tank 78 via a line 96 and the line 82. Thus, fluid can be discharged from the control valve 48 into the tank 78 under conditions to be described.

The counterbalance valves 54 and 64 are normally closed, but are adapted to open in response to a predetermined fluid pressure being applied to the valves by the lines 74 and 76, respectively. When the counterbalance valve 54 is in its open position, fluid is allowed to flow from upstream of the control valve 48, through the valves 48 and 54, and to the cylinder 30 as indicated by the flow arrows. Fluid is allowed to flow in the reverse direction from the cylinder 30, through the counterbalance valve 54 and to the tank 78, either via the control valve 48 or via the check valves 60 and 90 in a manner to be described. When the counterbalance valve 54 is in its closed position, fluid is still allowed to flow from upstream of the control valve 48 to the cylinder 30 via the valve 48 and the check valve included in the counterbalance valve 54. However, reverse fluid flow from the cylinder 30 to the tank 78 via the counterbalance valve 54 is not allowed when the counterbalance valve 54 is in its closed position.

When the counterbalance valve 64 is in its open position, fluid is allowed to flow from the control valve 48 to the relief valve 68 as indicated by the flow arrows. When the counterbalance valve 64 is in its closed position, fluid is not allowed to flow from the control valve 48 to the relief valve 68. Reverse fluid flow through the counterbalance valve 64, that is, fluid flow from the relief valve 68 to the control valve 48, is not possible, regardless of whether the counterbalance valve 64 is in its open or closed position.

Assuming that the tubing 20 (FIG. 1) is passed into the injector 10 in the manner described above and it is desired to extend the cylinder 30 so that the stripper 16 sealingly engages the tubing 20 for the purpose of preventing the release of wellbore fluids from the well 12, an appropriate valve, pump or the like (not shown), associated with the source 34 is activated. Thus, pressurized fluid flows into the line 38 and pressurizes the line 38 up to the pressure reducing valve 36. The pressure reducing valve 36 is set to pass a portion of this fluid to the switching valve 40 in the manner discussed above, reducing the pressure across the valve 36, that is, from the line 38 to the line 42 to a pressure corresponding to the maximum sealing pressure that the stripper 16 may exert on the tubing 20.

Assuming the switching valve 40 is in its normal mode in which it connects the line 42 to the line 46, the lines 42 and 46 are pressurized. Thus, pressurized fluid flows into the line 46 and pressurizes that portion of the line 46 extending to the control valve 48 to the above pressure corresponding to the maximum sealing pressure that the stripper 16 may exert on the tubing 20. The control valve 48 is set to pass a portion of this fluid to the cylinder 30 in the manner discussed above, which portion is sufficient to establish a normal operating fluid pressure in the cylinder 30 that corresponds to the normal operating sealing pressure that is exerted by the stripper 16 on the tubing 20. The remaining portion of the fluid from the control valve 48 will bleed off and pass through the line 66, the counterbalance valve 64, and to the relief valve 68.

Pressurized fluid also flows from the source 34 to the switching valve 70. Assuming that the valve 70 is in its normal mode in which it connects the source 34 to the line 74, fluid flows from the source 34, through the line 72 and the switching valve 70, and to the lines 74 and 76 to pressurize the lines 74 and 76. The counterbalance valves 54 and 64 are normally closed and the lines 74 and 76, respectively, serve as pilot lines for the valves 54 and 64 and thus open the valves 54 and 64 and allow pressure to be transmitted through the valves 54 and 64.

The output pressure from the control valve 48 is transmitted to one end of the cylinder 30 via the line 56, the counterbalance valve 54 and the line 62. Assuming that the rod **30*b* of the cylinder 30 is in a retracted position as a result of a previous operation, the rod 30*b* will extend when subjected to this pressure, thus causing the stripper 16 to apply a sufficient amount of load against the tubing 20 to sealingly engage the tubing. Assuming the switching valve 40 is in its normal mode in which it connects the line 88 to the line 86, the extension of the cylinder 30 will force fluid from the other end of the cylinder 30 to the switching valve 40 via the line 88, and to the tank 78 via the lines 86 and 82**, as shown by the flow arrows.

Due to the opening of the counterbalance valve 64, some of the fluid from the control valve 48 will bleed off and pass through the line 66, the counterbalance valve 64, and to the relief valve 68. The control valve 48 and the relief valve 68 are designed so that the relief valve 68 can control the amount of fluid that can be bled off from the control valve 48 in the above manner, and therefore the fluid pressure passing to the cylinder 30. In particular, to increase the amount of sealing pressure on the tubing 20, the relief valve 68 is adjusted to reduce the amount of flow being bled off from the control valve 48, thereby increasing the output pressure in the line 56 and the amount of pressure applied to the cylinder 30 and the sealing pressure on the tubing 20. To decrease the amount of sealing pressure on the tubing 20, the relief valve is adjusted to increase the amount of flow being bled off from the control valve 48, thereby decreasing the output pressure in the line 56.

When the fluid applied to the cylinder 30 is at the desired pressure corresponding to the desired sealing pressure, or load, that the stripper 16 exerts on the tubing 20, the relief valve 68 is no longer adjusted and the output pressure in the line 56 remains constant, thereby applying constant loading on the tubing 20.

In situations where the tubing 20 is part of a string having a varying diameter, constant pressure on the cylinder 30 can always be maintained despite the fact that the diameter of the tubing 20 varies as it passes through the stripper 16. Specifically, if the diameter of the tubing 20 increases during the above mode, it causes a corresponding retraction of the cylinder 30 from the above-described extended position. However, an unsafe pressure increase in the cylinder 30 is avoided because the fluid in the cylinder 30 will be forced out of the cylinder 30 and will flow to the control valve 48 through the line 62, the counterbalance valve 54 and the line 56 in a direction opposite that shown by the arrows in FIG. 2. This reverse fluid flow through the counterbalance valve 54 is possible because the counterbalance valve 54 is still open due to the fluid pressure being applied to the counterbalance valve 54 by the line 74. This reverse fluid flow triggers the above-mentioned relief mechanism in the control valve 48 in a conventional manner, enabling fluid to flow from the control valve 48 to the tank 78 via the lines 96 and 82. Thus, only as much fluid as necessary flows from the cylinder 30 to the tank 78 in order to maintain constant pressure on the tubing 20. If the diameter of the tubing 20 decreases, additional fluid will enter the cylinder 30 from the source 34 via the control valve 48 in the manner described above, thereby maintaining constant pressure on the cylinder 30 and thus the tubing 20. Also, if additional fluid is unavailable from the source 34, additional fluid may enter the cylinder 30 from the accumulator 50 via the control valve 48 and the counterbalance valve 54.

Assuming that the stripper 16 is exerting sealing pressure on the tubing 20 in accordance with the foregoing, if there is a significant loss in the fluid pressure available from the source 34 for whatever reason, the pressure level in the line 46, which is normally at the maximum sealing pressure discussed above, will drop significantly. When this occurs, there is no immediate effect on the pressure in that portion of the line 46 downstream of the check valve 44 or the accumulator 50 because the check valve 44 maintains the maximum sealing pressure downstream from its location in the line 46. Likewise, the closed check valve 90 prevents fluid from flowing from the line 46 to the tank 78 via the lines 94 and 82, thereby holding the pressure level in the line 46 downstream of the check valve 44 at the maximum sealing pressure.

In response to any significant loss in the fluid pressure available from the source 34, the pressure in the lines 72 and 74 also drop accordingly. Since the line 74 serves as the pilot line for the counterbalance valve 54, this pressure drop causes the counterbalance valve 54 to close, thereby holding the sealing pressure in the cylinder 30. Similarly, the pressure drop in the line 74 causes a pressure drop in the line 76, thus causing the counterbalance valve 64 to close and prevent fluid from being bled off from the control valve 48 via the line 66.

Also in response to the above significant loss in the fluid pressure available from the source 34, the normal operating pressure placed on the cylinder 30 will not only be maintained as discussed above, but the pressure on the cylinder 30 will be increased for safety purposes. In particular, the output pressure of the control valve 48, and therefore the pressure on the cylinder 30, will increase because initially the pressure in the line 46 downstream of the check valve 44 is higher than the pressure in the line 56 and fluid can no longer be bled off from the control valve 48 via the line 66, as discussed above. This pressure increase is possible due to the fact that the above-mentioned check valve included in the counterbalance valve 54 will allow pressure to be transmitted to the cylinder 30, but will prevent pressure to be transmitted in the opposite direction from the cylinder 30, even though the counterbalance valve 54 is closed. Also, additional fluid provided to the line 46 by the accumulator 50 will be transmitted to the cylinder 30 through the control valve 48, the check valve included in the counterbalance valve 54, and the lines 56 and 62, to place additional pressure on the cylinder 30. Thus, the cessation of pressure bleeding from the control valve 48 and the additional pressure provided by the accumulator 50 will result in the sealing pressure provided by the cylinder 30 rising to a value that is significantly higher than the normal operating sealing pressure.

When the full fluid pressure in the source 34 is restored, the counterbalance valves 54 and 64 will automatically open again, allowing pressure to be bled off from the control valve 48, thereby reducing the pressure on the cylinder 30. The sealing pressure will then be able to be controlled as usual by the relief valve 68. Thus, the operator does not have move near the stripper 16 to restart normal stripper 16 control and operation.

The circuit 32 is also adapted to operate in an emergency mode in the event it is desired to terminate normal operation of the stripper 16 for some unforeseen reason. In this case the operator would manually switch the switching valve 70 so that the above-mentioned connection between the line 74 and the source 34 is terminated and a connection is established between the line 74 and the tank 78 via the line 82, as discussed above. Thus, fluid in the line 74 is passed to the tank 78 resulting in a significant pressure drop in the line 74, similar to the pressure drop experienced when the fluid pressure at the source 34 is lost as discussed above.

When the pressure in the line 74 drops, the counterbalance valve 54 closes, thus holding the sealing pressure in the cylinder 30. Similarly, the counterbalance 64 closes due to the drop in pressure in the line 74 and therefore the line 76, thus preventing pressure from being bled off from the control valve 48. As a result, the pressure at the control valve 48, and therefore the pressure in the line 56, increases and is transmitted to the cylinder 30 via the check valve included in the closed counterbalance valve 54, as discussed above, and the line 62. The output pressure will increase all the way up to the maximum sealing pressure since the source 34 is still pressurized and the pressure reducing valve 36 still operates to reduce the source 34 pressure in the line 38 to the maximum sealing pressure in the line 42. Thus, the accumulator 50 does not have to provide additional pressure to the cylinder 30 as in the previous mode. The output pressure of the control valve 48, and therefore the pressure placed on the cylinder 30, ceases to increase and remains constant after reaching the maximum sealing pressure.

The cylinder 30 will remain at the maximum sealing pressure until the operator manually switches the switching valve 70 to connect the line 74 back to the source 34 upon resolution of the emergency situation. When this occurs, the pressure in the line 74 will increase back up to the source 34 pressure, resulting in the opening of the counterbalance valves 54 and 64. This allows the resumption of pressure bleeding from the control valve 48, thereby decreasing the pressure placed on the cylinder 30 via the open counterbalance valve 54. The operator may then control the sealing pressure using the relief valve 68, as described above.

When it is desired to unseal the tubing 20, the cylinder 30 is moved from its extended position discussed above to its retracted position. To achieve this opening action, the switching valve 40 is switched to connect the line 42 to the line 88, and to connect the line 46 to the line 86. This results in fluid flowing to the cylinder 30 via the pressure reducing valve 36, the switching valve 40, and the lines 38, 42 and 88. The fluid flows in the lines 38 and 42 in the direction of the corresponding flow arrows shown in FIG. 2. However, the fluid flows in the line 88 in a direction opposite the direction of the corresponding flow arrows. As a result, the cylinder 30 retracts, forcing fluid out of the cylinder 30, through the line 62, the counterbalance valve 54, the line 56, the line 58, the check valve 60, and to the line 94, also in a direction opposite the flow arrows (with the exception of the flow arrow for the line 58).

Fluid is allowed to flow through the counterbalance valve 54 since the line 74 is still pressurized at the source 34 pressure, which maintains the counterbalance valve 54 in its open position. Also, although fluid will not flow from the line 56 to the line 46 through the control valve 48, fluid will flow from the line 56 into the line 58 and to the check valve 60. Since the pressure in the line 56 is greater than the pressure in the line 46, the check valve 60 will open causing the fluid to flow, via the line 58 to the line 94. Pressurization of the line 88 also results in the pressurization of the pilot line 92, which opens the check valve 90 to allow fluid to flow from the line 58, through the lines 94 and 82, and to the tank 78. As a result, the fluid discharging from the cylinder 30 is allowed to drain to the tank 78. Also, the opening of the check valve 90 allows the fluid stored in the accumulator 50 to discharge to the tank 78 via the lines 52, 46, 58, 94 and 82.

During this cylinder 30 open mode, the counterbalance valve 64 remains open because the lines 74 and 76 are still pressurized at the source 34 pressure as discussed above. However, pressure is not bled off from the control valve 48 to the counterbalance valve 64 since the pressure in the line 56 is greater than the pressure in the line 46 and therefore the counterbalance valve 64 is not employed.

VARIATIONS

It is understood that variations may be made in the foregoing without departing from the scope of the invention. For example, although one cylinder 30 is used in the stripper 16 and the circuit 32, the quantity of cylinders 30 may be increased.

Moreover, other types of valves may be substituted for the valves employed in the exemplary embodiment. For example, a pilot-operated check valve may be substituted for each counterbalance valve employed in the exemplary embodiment. Also, in addition to the injector 10 and the stripper 16, other configurations and/or types of injectors and strippers may be employed in conjunction with the circuit 32.

Further, pressure gauges may be connected to the circuit 32 at various locations. For example, a pressure gauge may be connected to the line 62 to measure the pressure in the cylinder 30. Also, an adjustable needle valve may be connected to the line 38 and may be closed after normal operation of the circuit 32 has begun, thereby preventing any fluid flow from the source 34 to the pressure reducing valve 36.

Still further, one or more of the circuits 32 may be employed in conjunction with the stripper 16 or with other types of strippers that include hydraulic actuated cylinders, and each circuit 32 may be independently controlled. These circuits 32 may all be connected to the same source 34, or the circuits 32 may be connected to separate and independent sources 34.

Still further, the circuit 32 may be modified so that it is comprised of two or more sub-circuits, with each sub-circuit essentially equivalent to the circuit 32 as shown in the exemplary embodiment. Such a modification may be carried out for redundancy purposes. For example, if the circuit 32 is comprised of two symmetric sub-circuits and if during operation one of the sub-circuits breaks and leaks fluid, the pressure in the cylinder 30 or cylinders 30 associated with the broken sub-circuit will drop significantly. However, the pressure in the cylinder 30 or cylinders 30 of the operational sub-circuit will still be able to maintain 50% of the stripper sealing pressure. In such an example, it is understood that one switching valve 40, one relief valve 68, one switching valve 70, and/or one source 34, or any combination thereof, may be employed to connect to and serve both sub-circuits.

It is understood that any foregoing spatial references, such as "side," "above," etc., are for the purpose of illustration only and do not limit the specific spatial orientation of the structure described above. It is also understood that the above-described circuit 32 is not limited to the application of pressure sealing as discussed above, but can be easily adapted to other applications.

Although an exemplary embodiment of this invention has been described in detail above, those skilled in the art will readily appreciate that many other variations and modifications are possible in the exemplary embodiment without materially departing from the novel teachings and advantages of this invention. Accordingly, all such variations and modifications are intended to be included within the scope of this invention as defined in the following claims.

The invention claimed is:

1. A hydraulic circuit for extending at least one cylinder to apply a load to an external member, comprising:

a source of fluid;

a first valve;

a second valve for receiving the fluid from the source and passing at least a portion of the fluid to the cylinder while selectively allowing some of the fluid to pass to the first valve;

wherein the first valve is adjustable to control the amount of fluid that it receives from the second valve and therefore control the amount of fluid passed from the second valve to the cylinder;

a third valve connected between the second valve and the cylinder and movable from an open position in which reverse fluid flow from the cylinder and through the third valve is permitted and to a closed position in which the reverse fluid flow from the cylinder and through the third valve is prevented.

2. The circuit of claim 1 wherein:

the third valve is connected to the source;

the third valve moves to its open position when fluid is received from the source; and the third valve moves to its closed position when fluid flow from the source is terminated.

3. The circuit of claim 2 further comprising a line connecting the source to the second valve, wherein the second valve and the third valve allow fluid in the line to pass to the cylinder upon termination of fluid flow from the source and closing of the third valve.

4. The circuit of claim 2 further comprising an additional source of fluid connected to the second valve, wherein the second valve passes fluid to the cylinder upon termination of fluid flow from the source and closing of the third valve.

5. The circuit of claim 1 further comprising a pilot line for flowing fluid from the source to the third valve to control its movement between the open and closed position.

6. The circuit of claim 5 further comprising a switching member connected to the pilot line, wherein the switching member is adapted to switch fluid flow between the source and the pilot line to a fluid flow between the source and an exhaust tank to close the third valve and prevent fluid flow from the second valve to the first valve.

7. The circuit of claim 1 further comprising an additional source of fluid connected between the source and the second valve for supplying additional fluid to the cylinder in response to termination of fluid flow from the first-mentioned source.

8. The circuit of claim 1 wherein the first valve controls the amount of the load applied by the cylinder to the external member.

9. The circuit of claim 1 wherein the cylinder receives fluid at a first portion of the cylinder to cause the cylinder to extend, and the circuit further comprises a line for connecting the source to a second portion of the cylinder to cause retraction of the cylinder and reduction of the load on the external member.

10. The circuit of claim 9 wherein:

fluid flows from the second portion of the cylinder through the line and to an exhaust tank during the extension of the cylinder; and fluid flows from the source through the line and to the second portion of the cylinder during the retraction of the cylinder.

11. The circuit of claim 1 further comprising an additional source of fluid connected between the first-mentioned source and the second valve for supplying the additional fluid to the cylinder in response to termination of fluid flow from the first-mentioned source.

12. A hydraulic circuit for extending at least one cylinder to apply a load to an external member, comprising:

a source of fluid;

a first valve;

a second valve for receiving the fluid from the source and passing at least a portion of the fluid to the cylinder while selectively allowing some of the fluid to pass to the first valve;

wherein the first valve is adjustable to control the amount of fluid that it receives from the second valve and therefore control the amount of fluid passed from the second valve to the cylinder; and a third valve connected between the second valve and the first valve and movable from an open position in which the fluid flow from the second valve to the first valve is permitted; and to a closed position in which the fluid flow from the second valve to the first valve is prevented.

13. The circuit of claim 12 wherein:

the third valve is connected to the source;

the third valve moves to its open position when fluid is received from the source; and the third valve moves to its closed position in response to the termination of fluid flow from the source.

14. A hydraulic circuit for extending at least one cylinder to apply a load to a section of tubing, the circuit comprising:

a source of fluid;

a first valve; and a second valve for receiving the fluid from the source and passing at least a portion of the fluid to the cylinder while selectively allowing some of the fluid to pass to the first valve;

wherein the first valve is adjustable to control the amount of fluid that it receives from the second valve and therefore control the amount of fluid passed from the second valve to the cylinder.

15. The circuit of claim 14 wherein:

the section of tubing moves relative to the cylinder as the cylinder applies the load;

the cylinder is adapted to discharge the fluid when the diameter of the tubing increases from a predetermined value; and the second valve has a relief mechanism to permit the amount of the load to remain constant.

16. The circuit of claim 14 wherein:

the section of tubing moves relative to the cylinder as the cylinder applies the load; and the cylinder is adapted to receive additional fluid to permit the amount of the load to remain constant when the diameter of the tubing decreases from a predetermined value.

17. The circuit of claim 14 further comprising a stripper connected to the cylinder, wherein the stripper is adapted to engage the tubing to transmit the load to the tubing.

18. The circuit of claim 17 wherein the stripper sealingly engages at least a portion of the tubing after a sufficient amount of load transmission.

19. A hydraulic circuit for extending at least one cylinder to apply a load to an external member, comprising:

a source of fluid;

a first valve;

a second valve for receiving the fluid from the source and passing at least a portion of the fluid to the cylinder while selectively allowing some of the fluid to pass to the first valve;

wherein the first valve is adjustable to control the amount of fluid that it receives from the second valve and therefore control the amount of fluid passed from the second valve to the cylinder;

wherein the cylinder receives fluid at a first portion of the cylinder to cause the cylinder to extend, and the circuit further comprises a line for connecting the source to a second portion of the cylinder to cause retraction of the cylinder and reduction of the load on the external member;

wherein the fluid flows from the second portion of the cylinder through the line and to an exhaust tank during the extension of the cylinder and from the source through the line and to the second portion of the cylinder during the retraction of the cylinder; and a switching member connected to the line, wherein the switching member is adapted to switch fluid flow between the line and the exhaust tank to fluid flow between the source and the line.

20. A hydraulic circuit for extending at least one cylinder to apply a load to an external member, comprising:

a source of fluid;

a first valve;

a second valve for receiving the fluid from the source and passing at least a portion of the fluid to the cylinder while selectively allowing some of the fluid to pass to the first valve;

wherein the first valve is adjustable to control the amount of fluid that it receives from the second valve and therefore control the amount of fluid passed from the second valve to the cylinder; and a third valve connected between the source and the second valve for receiving the fluid from the source and passing at least a portion of the fluid to the second valve while selectively allowing some of the fluid to pass to an exhaust tank, wherein the third valve is adjustable to control the amount of fluid passed from the third valve to the second valve.

21. A method comprising the steps of:

passing fluid from a source to at least one hydraulically operated device while selectively allowing another portion of the fluid from the source to pass to a first valve;

adjusting the first valve to control the amount of fluid passed to the first valve and therefore the amount of fluid passed to the device; and sealingly engaging at least a portion of an external member by continuing the step of passing.

22. The method of claim 21 wherein the step of sealingly engaging comprises the step of transmitting a load from the device to the external member.

23. The method of claim 21 wherein the flow from the source is passed through a second valve for passing to the device and to the first valve, and the method further comprises the steps of:

connecting a third valve between the second valve and the device;

moving the third valve from an open position in which reverse fluid flow from the device and through the third valve is permitted; and moving the third valve to a closed position in which the reverse fluid flow from the device and through the third valve is prevented.

24. The method of claim 23 further comprising the steps of:

connecting the third valve to the source;

moving the third valve to its open position when it receives fluid from the source; and moving the third valve to its closed position when fluid flow from the source is terminated.

25. The method of claim 24 further comprising the steps of:

preventing fluid flow from the device to the source upon termination of fluid flow from the source; and closing of the third valve.

26. The method of claim 23 further comprising the steps of:

connecting a flow line between the source and the second valve;

passing fluid in the line to the device upon termination of fluid flow from the source; and closing of the third valve.

27. The method of claim 23 further comprising the steps of:

passing fluid from an additional source of fluid to the device upon termination of fluid flow from the source; and closing of the third valve.

28. The method of claim 23 further comprising the step of passing fluid from the source to the third valve to control its movement between the open and closed position.

29. The method of claim 23 further comprising the step of connecting an additional source of fluid between the first-mentioned source and the second valve for supplying the additional fluid in response to termination of fluid flow from the first-mentioned source.

30. The method of claim 23 further comprising the steps of:

connecting a fourth valve between the second valve and the first valve;

moving the fourth valve from an open position in which fluid flows from the second valve to the first valve; and moving the fourth valve to a closed position in which the fluid flow from the second valve to the first valve is prevented.

31. The method of claim 30 further comprising the steps of:

connecting the fourth valve to the source;

moving the fourth valve to its open position when fluid is received from the source; and moving the fourth valve to its closed position in response to the termination of fluid flow from the source.

32. The method of claim 21 wherein the external member is a section of tubing.

33. The method of claim 32 wherein the step of sealingly engaging comprises the step of connecting a stripper to the device for transmitting a load from the device to the tubing.

* * * * *